US008698632B2

(12) United States Patent
Zinner

(10) Patent No.: US 8,698,632 B2
(45) Date of Patent: Apr. 15, 2014

(54) SURVEILLANCE DEVICE

(75) Inventor: Ulrich Zinner, Philadelphia (ZA)

(73) Assignee: Bell-Oak Investment (Pty) Ltd (ZA)

( * ) Notice: Subject to any disclaimer, the term of this patent is extended or adjusted under 35 U.S.C. 154(b) by 285 days.

(21) Appl. No.: 12/681,778

(22) PCT Filed: Oct. 3, 2008

(86) PCT No.: PCT/IB2008/054064

§ 371 (c)(1),
(2), (4) Date: Apr. 5, 2010

(87) PCT Pub. No.: WO2009/044378

PCT Pub. Date: Apr. 9, 2009

(65) Prior Publication Data

US 2010/0219954 A1 Sep. 2, 2010

(30) Foreign Application Priority Data

Oct. 4, 2007 (ZA) ..... 2007/08504

(51) Int. Cl.
*G08B 13/14* (2006.01)

(52) U.S. Cl.
USPC ..... 340/572.8; 340/571; 340/572.2; 340/572.6; 70/57.1

(58) Field of Classification Search
USPC ..... 340/572.6, 572.5, 572.8, 571–572.9; 70/57.1
See application file for complete search history.

(56) References Cited

U.S. PATENT DOCUMENTS

| | | | | |
|---|---|---|---|---|
| 5,955,951 | A * | 9/1999 | Wischerop et al. | 340/572.8 |
| 7,109,867 | B2 * | 9/2006 | Forster | 340/572.3 |
| 2004/0207528 | A1 * | 10/2004 | Fabian et al. | 340/572.6 |
| 2005/0190060 | A1 * | 9/2005 | Clancy et al. | 340/572.9 |
| 2006/0017574 | A1 * | 1/2006 | Skjellerup | 340/572.9 |
| 2006/0022831 | A1 * | 2/2006 | Mori | 340/572.6 |
| 2007/0080808 | A1 * | 4/2007 | Hasegawa et al. | 340/572.6 |
| 2007/0194927 | A1 * | 8/2007 | Peter et al. | 340/572.5 |

* cited by examiner

*Primary Examiner* — George Bugg
*Assistant Examiner* — Sharmin Akhter
(74) *Attorney, Agent, or Firm* — Hahn Moodley LLP; Vani Moodley, Esq.

(57) ABSTRACT

An EAS tag (10) is provided, which includes a body (12) with an internal cavity (16), attachment means (14,26) for removably attaching the tag (10) to an article, an amorphous metal strip (48) inside the cavity (16) and a permanent magnet (34) inside the housing (12). The permanent magnet (34) is preferably an elongate rare earth magnet and is positioned generally equally far from the ends of the amorphous metal strip (48), preferably in a position spaced laterally from the amorphous strip (48) and generally parallel to the amorphous strip.

5 Claims, 3 Drawing Sheets

Fig. 5

SURVEILLANCE DEVICE

FIELD OF THE INVENTION

This invention relates to electronic article surveillance (EAS) security devices or tags that can be applied to articles such as merchandise to inhibit theft or pilfering. In particular, the invention relates to a non-deactivateable EAS tag.

BACKGROUND TO THE INVENTION

Security devices in the form of tags that can be attached to merchandise in EAS systems are widely used to alert retailers to unauthorised removal of tagged merchandise from their premises.

Some types of EAS tags can be activated to prevent unauthorised removal and can be deactivated when removal of the tagged article from premises is permissible. And example of the use of such a system is in libraries, where tags containing magneto-harmonic markers (also known in the art as "sensors") are magnetised to deactivate the tags when a book may leave the library and are demagnetised to activate the tags upon the book's return, to prevent unauthorised removal of the book.

Another type of EAS device is known as a "hard tag" and includes a rigid body housing an EAS sensor and a tack. The tack has a shank with a sharp end that can pass through an article of merchandise and that can be received in an aperture in the tag body, where it is held firmly to prevent removal of the tag from the article of merchandise. When the merchandise may legitimately leave the premises under surveillance, the tag is removed from the article of merchandise with a purpose-built detacher, which releases the tack to be withdrawn from the body. The EAS tag can be configured as a disposable or re-usable tag.

Hard tags of this type are intended to be kept on the premises and are removed from merchandise that may leave the premises, with the result that it is not necessary and is generally undesirable to deactivate the tags. However, hard tags that are presently used typically include an acousto-magnetic (AM) sensor comprising of an amorphous metal strip and a ferromagnetic strip alongside the amorphous strip, generating a magnetic field of a predetermined strength. The tags can be deactivated if the strength of the magnetic field can be altered sufficiently and this can be done by bringing a sufficiently strong magnet into proximity of the tag. Accordingly, it is possible for shoplifters to use strong magnets to deactivate these tags and to remove tagged merchandise from the premises undetected.

A solution to this problem was proposed in U.S. Pat. No. 6,348,865 (to Siegel), in which the ferromagnetic strip is replaced by two permanent magnets that are positioned in diagonally opposing positions at the ends of the amorphous metal strip. However, the use of two permanent magnets is costly.

Many EAS tags that are presently in use, can be removed from the articles of merchandise to which they have been attached, using heat (e.g. from a hand held cigarette lighter) to overcome the attachment means of the tag to the merchandise.

The present invention seeks to provide an EAS tag including a cost effective AM sensor that cannot be deactivated magnetically. The invention also seeks to provide an EAS tag that offers resistance to tampering with its attachment means using heat. The invention further seeks to provide an EAS tag that can house multiple sensors, preferably different types of sensors.

SUMMARY OF THE INVENTION

According to the present invention there is provided an EAS tag which includes:

- a body defining an internal cavity;
- attachment means for removably attaching the tag to an article;
- at least one amorphous metal strip inside the cavity; and
- at least one permanent magnet inside the housing;
- wherein said magnet is disposed generally equally far from the ends of the amorphous metal strip.

The term "permanent magnet" refers to a magnet that can generally not be deactivated to the extent that renders it inoperative for the purpose of this invention.

The magnet may be a rare earth magnet and may be elongate in shape. The magnet may be disposed in a position spaced laterally from the amorphous strip and may extend generally parallel to the amorphous strip. Preferably, the tag may include a single, permanent magnet.

The magnet may be at least 2 mm away from the metal strip, preferably about 6 to 15 mm away from the metal strip.

The tag may include at least one further sensor, e.g. a radio frequency (RF) or an EM sensor, housed in the body.

The attachment means may include an aperture defined in the body and a tack with a shank that can be received in the aperture in a releasable lock mechanism. The lock mechanism may include a lock body that is displaceable between a lock position and a free position and which may be biased towards the lock position and may be magnetically displaceable towards the free position.

The tag may include a cover that surrounds the lock mechanism at least in part and the cover may be of a heat resistant material such as a metal, to protect the lock mechanism against damage, especially damage inflicted with heat.

BRIEF DESCRIPTION OF THE DRAWINGS

For a better understanding of the present invention, and to show how the same may be carried into effect, the invention will now be described by way of non-limiting example, with reference to the accompanying drawings in which.

DETAILED DESCRIPTION OF THE DRAWINGS

Figure 1:
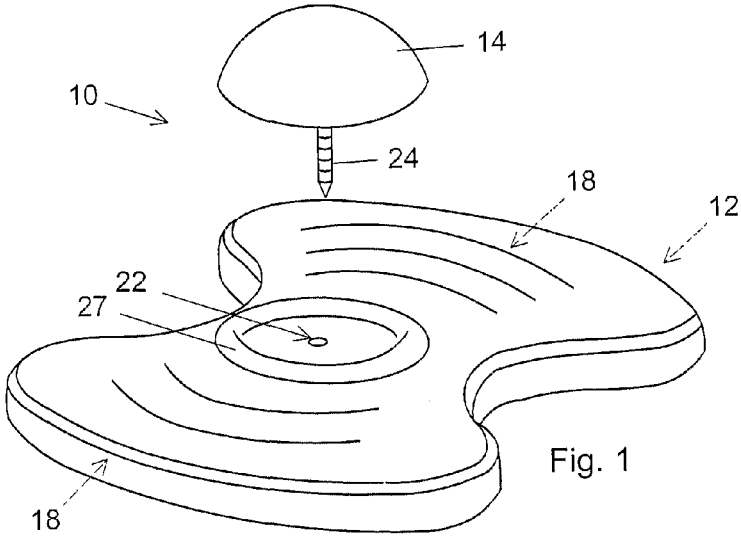
FIG. 1 is a three dimensional view of an EAS tag in accordance with the present invention, with its tack withdrawn.
Figure 2:
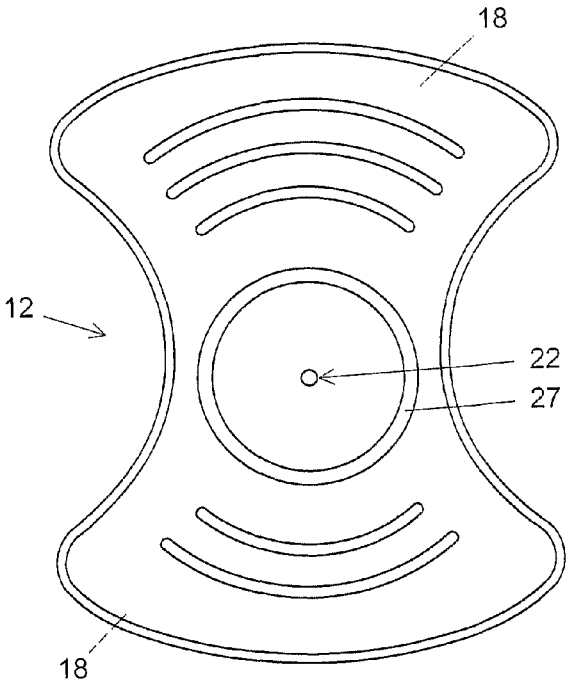
FIG. 2 is a front view of the body of the tag of FIG. 1.
Figure 3:
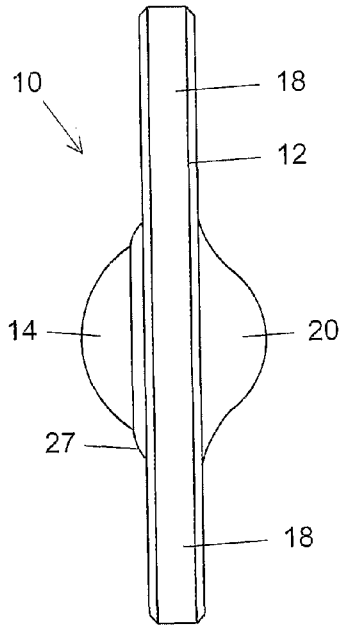
FIG. 3 is a side view of the tag of FIG. 1 with its tack inserted.

Referring to the drawings, an EAS tag in accordance with the present invention is generally indicated by reference numeral 10 and comprises of a tag body 12 and a tack 14.

The body 12 comprises of a sealed shell of hard plastic material and defines a cavity 16 inside, in which its internal components are housed. The body 12 is shaped to be relatively thin, with two opposing wing-like protuberances 18 in which EAS sensors are housed and with a central bulge 20. On the side of the body 12 opposite from the bulge 20, an aperture 22 is defined, into which the shank 24 of the tack 14 can be inserted to be held captive inside the body 12 by a releasable lock mechanism 26. The shank 24 can thus be passed through an aperture in an article of merchandise to be tagged, before being inserted into the aperture 22 and being locked inside the lock mechanism 26, to serve as attachment means for removably attaching the tag 10 to the merchandise. A circular ridge 27 extends around the aperture 22 to form a recess in which the head of the tack 14 can be received, to prevent objects from being inserted between the tack head and the body 12.

Figure 4:
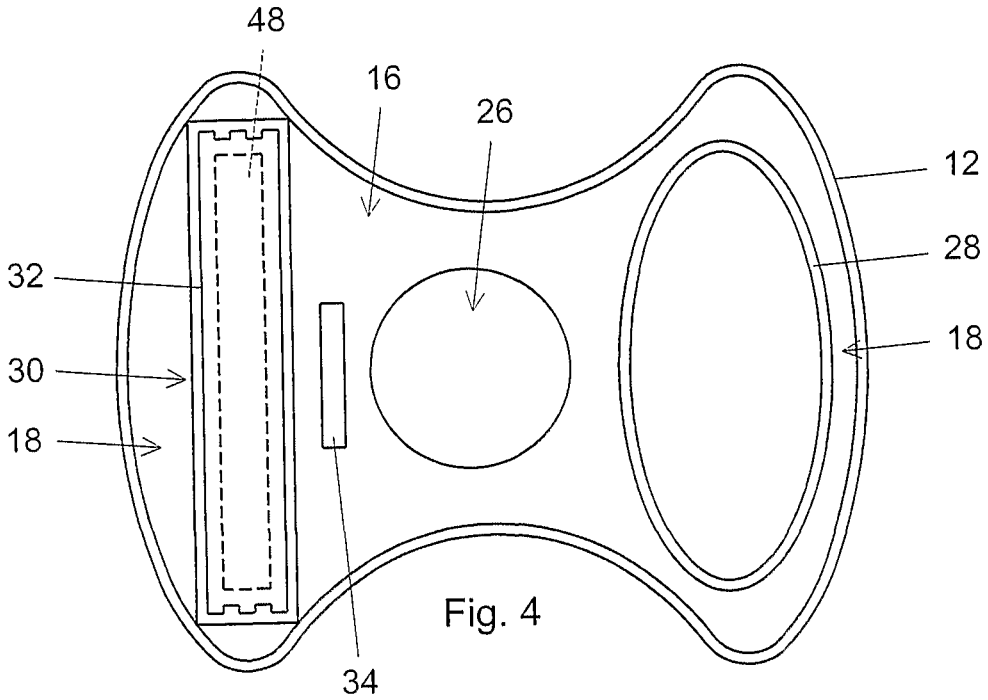
FIG. 4 is a diagrammatic front view of the inside of the tag of FIG. 1.
Figure 6:
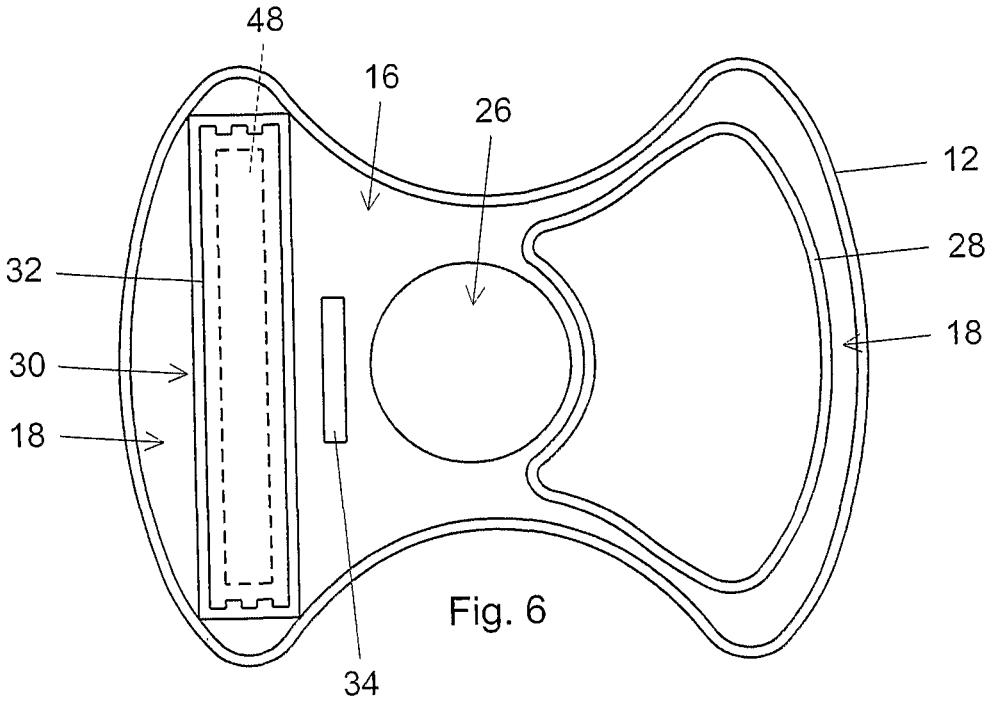
FIGS. 6 and 7 are diagrammatic front view of the inside of the tag of FIG. 1, showing alternative embodiments of its RF sensor.
Figure 7:
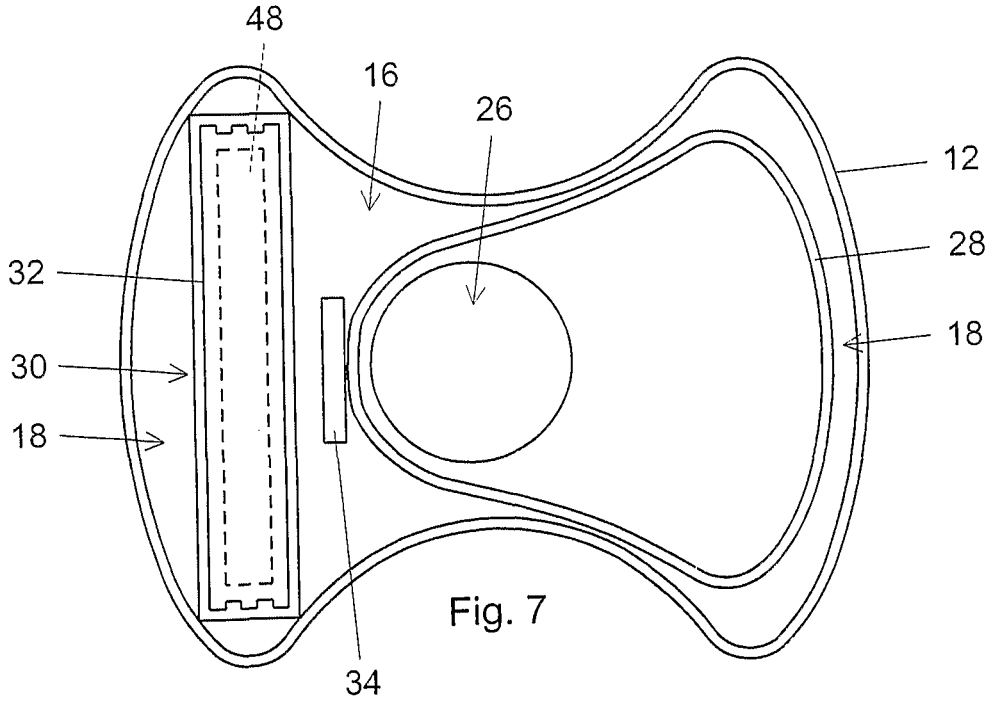

Referring to FIG. 4, details of the lock mechanism 26 have been omitted, but the two EAS sensors of the tag are shown in the form of an RF coil 28 and an AM sensor 30, each in the cavity 16 in a respective wing 18 of the body 12. In FIGS. 6 and 7, other embodiment of the tags of FIG. 4 are shown, which are identical to the tags of FIG. 4, but in which the RF coils 28 are shaped differently, to follow the outline of the cavity 16 in the case of FIG. 6 and to extend around the lock mechanism 26 in the case of FIG. 7.

The AM sensor 30 includes an elongate cover 32 of thin plastic material that is adhesively attached to a wall of the body 12. The cover 32 defines an internal cavity in which a thin strip 48 of amorphous metal is housed with clearance, so that the amorphous metal strip can vibrate/resonate inside the cover. The cover 32 and amorphous metal strip are very similar to the corresponding components of existing AM sensors, but unlike existing AM sensors, the AM sensor 30 of the present invention does not include a soft ferromagnetic strip adjacent the amorphous metal strip. Instead, the AM sensor 30 includes a permanent, rare earth magnet 34 in the form of a relatively small, elongate cylindrical bar that extends generally parallel to the cover 32 and thus to the amorphous metal strip, but that is laterally spaced from the cover.

Depending on the strength of the magnet 34, it can be placed closer to the cover 32 or further from it, but in order to ensure that the amorphous metal strip is surrounded by a magnetic field that will allow it to resonate when the tag 10 passes through an acousto-magnetic detector, the magnet 34 has to be positioned generally midway along the length of the amorphous metal strip, i.e. generally equally far from the ends of the amorphous metal strip.

Figure 8:
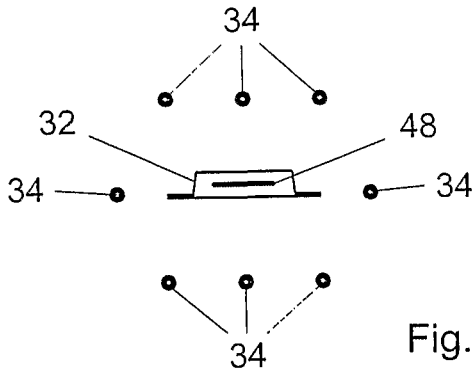
FIG. 8 is an end view of an AM sensor of the tag of FIG. 1, showing alternative positions for its magnet.

The magnet 34 is practically always more than 2 mm away from the housing 32 and ferromagnetic strip 48. In preferred embodiments of the invention, the magnet 34 is typically 6 to 11 mm away from the strip 48 and in some examples, up to 15 mm away from the strip. Further, as shown in FIG. 8, the magnet 34 need not necessarily be on one side of the strip 48 as shown in FIG. 4, but can be on the other side of the strip, above or below it. FIG. 7 shows illustrative examples of different positions that the magnet 34 can have relative to the strip 48, with the strip seen in end view.

It is possible to use more than one permanent magnet 34 to provide the required magnetic field in the vicinity of the amorphous metal strip, but the use of a single magnet is preferred for cost considerations.

The nature of the rare earth magnet 34 is such that it's magnetic field cannot be permanently changed by exposing it to a strong magnetic field, with the result that the AM sensor 30 cannot be deactivated in such a manner.

Figure 5:
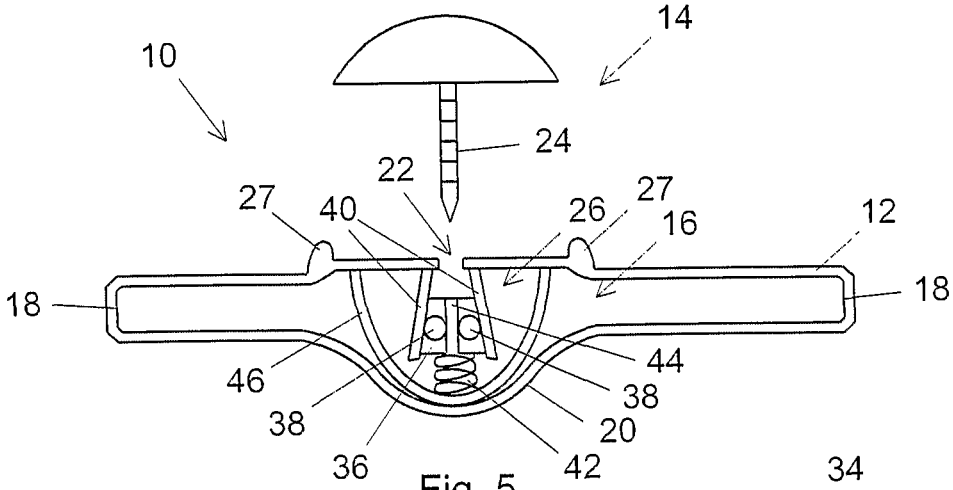
FIG. 5 is a diagrammatic sectional view through the tag of FIG. 1, showing its lock mechanism.

Referring to FIG. 5, the lock mechanism 26 includes a lock body 36 that houses a number of metal balls 38 with clearance and the lock body is held on the inside of a conically tapering metal wall 40 by a compression spring 42. The lock body 36 defines an internal bore 44 into which the balls 38 can protrude and that is aligned with the aperture 22. A metal cover in the form of an aluminium cup 46 surrounds the lock mechanism 26 to protect it against damage, especially damage inflicted with heat. In other embodiments, the cup 46 can be lined with a heat resistant material, such as a heat resistant foil.

When the shank 24 is inserted into the lock mechanism 26, is passes through the bore 44 and the balls 38 press against the shank and against the inside of the tapering wall 40. If the shank 24 is pulled to withdraw it from the lock mechanism 26, the balls 38 grip the shank more tightly in a taper lock, as a result of their contact with the tapering wall 40. The grip of the balls 38 on the shank 24 is enhanced by circumferential ribs on the shank and the balls are kept in position to exert the taper lock on the shank, by virtue of the bias exerted on the body 36 by the spring 42 which urges into the tapering wall 40, i.e. into a lock position.

The body 36 is of a material that allows it to be attracted by magnetism and when the tack 14 needs to be removed from the body 12, the tag 10 is exposed to a magnetic field that pulls the body 36 against the bias of the spring 42, to a free position in which the taper lock of the balls 38 on the shank 24 is released.

The invention claimed is:

1. An electronic article surveillance tag comprising:

a body defining an internal cavity;

attachment means for removably attaching the tag to an article;

an amorphous metal strip inside the cavity; and one permanent magnet inside the housing;

wherein said permanent magnet is a single rare earth magnet in the shape of a elongate cylindrical bar, relatively small with respect to said amorphous metal strip, and is disposed generally equally far from the ends of the amorphous metal strip, is spaced between 6 and 15 mm away laterally from the amorphous metal strip, and extends generally parallel to the amorphous strip, wherein the tag includes at least one further sensor, housed in the body.

2. An electronic article surveillance tag comprising:

a body defining an internal cavity;

attachment means for removably attaching the tag to an article;

an amorphous metal strip inside the cavity; and one permanent magnet inside the housing;

wherein said permanent magnet is a single rare earth magnet in the shape of a elongate cylindrical bar, relatively small with respect to said amorphous metal strip, and is disposed generally equally far from the ends of the amorphous metal strip, is spaced between 6 and 15 mm away laterally from the amorphous metal strip, and extends generally parallel to the amorphous strip, wherein the attachment means includes an aperture defined in the body and a tack with a shank that can be received in the aperture in a releasable lock mechanism, said lock mechanism including a lock body that is displaceable between a lock position and a free position, and said lock body being biased towards the lock position and being magnetically displaceable towards the free position.

3. An electronic article surveillance tag according to claim 2, wherein the tag includes a cover that surrounds the lock mechanism at least in part.

4. An electronic article surveillance tag according to claim 3, wherein the cover is of a heat resistant material.

5. An electronic article surveillance tag comprising:

a body defining an internal cavity;

attachment means for removably attaching the tag to an article;

an amorphous metal strip inside the cavity; and one permanent magnet inside the housing;

wherein said permanent magnet is a single rare earth magnet in the shape of a elongate cylindrical bar, relatively small with respect to said amorphous metal strip, and is disposed generally equally far from the ends of the amorphous metal strip, is spaced between 6 and 15 mm away laterally from the amorphous metal strip, and extends generally parallel to the amorphous strip, wherein the tag includes a cover of plastic material that is adhesively attached to a wall of the body, the cover defining an internal cavity in which said thin amorphous metal strip is housed with clearance, so that the amorphous metal strip can resonate inside the cover, and wherein said permanent magnet extends generally parallel to the cover and thus the amorphous metal strip, said permanent magnet being laterally spaced from said amorphous metal strip and from said cover.

* * * * *